US008225456B2

(12) United States Patent
Håkan et al.

(10) Patent No.: US 8,225,456 B2
(45) Date of Patent: Jul. 24, 2012

(54) HAND HELD VACUUM CLEANER

(75) Inventors: Miefalk Håkan, Järfälla (SE); Bergling Fredrik, Nyhamnsläge (SE); Jonsson Stefan, Stockholm (SE); Svantesson Esbjörn, Täby (SE); Ågren Christian, Stockholm (SE)

(73) Assignee: AB Electrolux, Stockholm (SE)

( * ) Notice: Subject to any disclaimer, the term of this patent is extended or adjusted under 35 U.S.C. 154(b) by 1457 days.

(21) Appl. No.: 10/544,927

(22) PCT Filed: Jan. 30, 2004

(86) PCT No.: PCT/SE2004/000136

§ 371 (c)(1),
(2), (4) Date: Apr. 13, 2007

(87) PCT Pub. No.: WO2004/069021

PCT Pub. Date: Aug. 19, 2004

(65) Prior Publication Data

US 2007/0271724 A1 Nov. 29, 2007

(30) Foreign Application Priority Data

Feb. 10, 2003 (SE) ..... 0300355

(51) Int. Cl.
*A47L 5/22* (2006.01)

(52) U.S. Cl. ..... 15/344; 15/329; 15/331; 15/339

(58) Field of Classification Search ..... 15/344, 15/329, 331, 339; *A47L 5/22*
See application file for complete search history.

(56) References Cited

U.S. PATENT DOCUMENTS 2,707,792 A 5/1955 Waller
2,863,524 A 12/1958 Buda
3,199,138 A 8/1965 Nordeen (Continued)

FOREIGN PATENT DOCUMENTS

CA 2087056 7/1994

(Continued)

OTHER PUBLICATIONS

Black & white printouts of http://www.zweita.net/ "Product Info" (3 pages).

(Continued)

*Primary Examiner* — David Redding
(74) *Attorney, Agent, or Firm* — Hunton & Williams LLP

(57) ABSTRACT

A hand held vacuum cleaner having a housing, a motor-fan unit, a dust container, an air passage opening into the dust container and through which dust laden air is directed into the dust container, and at least one filter arranged after the dust container, as seen in the flow direction. The dust container has a first emptying opening, which is normally being covered by a lid and is sized such that it allows the dust collected in the dust container to fall out through the opening when the lid is opened. The dust container also has a second emptying opening. In one aspect, the second emptying opening is adapted to be fluidly connected to an external vacuum source via a connection. In another aspect, a similar device is provided, and adapted so the dust container can be emptied through the first emptying opening without removing the dust container from the vacuum cleaner. In another aspect, the invention provides a vacuum cleaner dust container having an air inlet, an air outlet, a first dirt outlet, and a second dirt outlet. The first and second dirt outlets are separate from the air outlet.

36 Claims, 7 Drawing Sheets

U.S. PATENT DOCUMENTS 3,621,640 A * 11/1971 Hiroshi et al. ..... 55/300
3,653,189 A 4/1972 Miyake et al.
3,906,219 A 9/1975 Stauffer
4,213,224 A 7/1980 Miller
4,276,070 A 6/1981 Hug
4,376,322 A 3/1983 Lockhart et al.
4,421,964 A 12/1983 Buchtel
4,467,493 A 8/1984 Buchtel
4,541,142 A 9/1985 Pudwill
4,545,089 A 10/1985 Oxel
4,573,234 A 3/1986 Kochte et al.
4,573,237 A 3/1986 Kochte et al.
4,621,390 A 11/1986 Hampton et al.
4,635,315 A 1/1987 Kozak
4,665,582 A 5/1987 Richmond et al.
4,670,701 A 6/1987 Sako et al.
4,704,765 A 11/1987 Ataka
4,745,654 A * 5/1988 Yamamoto et al. ..... 15/344
4,748,713 A 6/1988 Sepke et al.
4,766,638 A 8/1988 McDowell
4,787,923 A 11/1988 Fleigle et al.
4,804,481 A 2/1989 Lennartz
D300,214 S 3/1989 Adams
4,821,366 A 4/1989 Levine
4,831,685 A 5/1989 Bosyj et al.
4,841,594 A 6/1989 Elson et al.
D304,104 S 10/1989 Busalt et al.
4,876,763 A 10/1989 Cho et al.
4,894,882 A 1/1990 Toya
4,899,418 A * 2/1990 Steiner et al. ..... 15/344
D307,657 S 5/1990 Li
4,920,606 A 5/1990 Gerke, Jr. et al.
4,920,608 A 5/1990 Hult et al.
4,928,346 A 5/1990 Elson et al.
4,934,020 A 6/1990 Jackson
4,942,641 A 7/1990 Gerke, Jr. et al.
4,947,514 A 8/1990 Gerke, Jr. et al.
4,967,443 A 11/1990 Krasznai et al.
4,993,106 A 2/1991 Hult et al.
5,005,252 A 4/1991 Steiner et al.
5,020,187 A 6/1991 Kosten et al.
5,025,529 A 6/1991 Hult et al.
5,035,024 A 7/1991 Steiner et al.
5,065,473 A 11/1991 Krasznai et al.
5,107,567 A * 4/1992 Ferrari et al. ..... 15/350
5,309,600 A 5/1994 Weaver et al.
5,322,534 A 6/1994 Kaiser
5,342,433 A 8/1994 Avondoglio
D352,807 S 11/1994 Sanderud
D364,013 S 11/1995 Klingspor et al.
5,524,321 A 6/1996 Weaver et al.
5,561,885 A 10/1996 Zahuranec et al.
5,584,095 A 12/1996 Redding et al.
5,603,740 A 2/1997 Roy
5,659,922 A * 8/1997 Louis ..... 15/350
5,661,885 A 9/1997 Donato
5,715,566 A 2/1998 Weaver et al.
5,733,351 A 3/1998 Hult et al.
5,819,364 A 10/1998 Sham
5,869,947 A 2/1999 Zahuranec et al.
5,966,774 A * 10/1999 Bone et al. ..... 15/344
6,029,313 A 2/2000 O'Dea et al.
6,094,775 A 8/2000 Behmer
6,108,864 A 8/2000 Thomas et al.
6,122,796 A * 9/2000 Downham et al. ..... 15/328
6,125,498 A 10/2000 Roberts et al.
6,131,239 A 10/2000 White
6,146,434 A 11/2000 Scalfani et al.
6,189,178 B1 2/2001 Roberts
6,311,366 B1 11/2001 Sepke et al.
6,324,714 B1 12/2001 Walz et al.
6,428,589 B1 8/2002 Bair et al.
6,434,785 B1 * 8/2002 Vandenbelt et al. ..... 15/344
6,546,592 B1 * 4/2003 Cockburn et al. ..... 15/344
6,562,093 B2 5/2003 Oh
6,571,421 B1 6/2003 Sham et al.
6,625,845 B2 9/2003 Matsumoto et al.
6,647,587 B1 11/2003 Ohara et al.
6,658,693 B1 12/2003 Reed, Jr.
6,736,873 B2 5/2004 Conrad et al.
6,766,558 B1 7/2004 Matsumoto et al.
6,775,882 B2 8/2004 Murphy et al.
6,811,584 B2 11/2004 Oh
6,824,580 B2 11/2004 Oh
6,839,934 B2 1/2005 Houghton et al.
6,857,165 B2 2/2005 Oh
6,928,690 B2 8/2005 Ji
6,948,211 B2 9/2005 Stephens et al.
6,964,082 B2 11/2005 Hsu
6,968,596 B2 11/2005 Oh et al.
7,377,007 B2 5/2008 Best
7,383,609 B2 6/2008 Ji
7,386,916 B2 6/2008 Bone
7,404,838 B1 7/2008 Pathak
7,412,749 B2 8/2008 Thomas et al.
7,507,269 B2 3/2009 Murphy et al.
2002/0042969 A1 4/2002 Nagai et al.
2002/0073504 A1 6/2002 Hall et al.
2002/0189048 A1 12/2002 Maruyama et al.
2003/0019073 A1 1/2003 Oh
2003/0159235 A1 8/2003 Oh
2003/0163887 A1 9/2003 Inoue
2003/0208879 A1 11/2003 Oh et al.
2003/0213091 A1 11/2003 Oh et al.
2004/0040270 A1 3/2004 Inoue et al.
2004/0098957 A1 5/2004 Yoo et al.
2004/0103496 A1 6/2004 Worwag
2004/0134022 A1 7/2004 Murphy et al.
2004/0177471 A1 9/2004 Jung et al.
2004/0187253 A1 9/2004 Jin et al.
2004/0200029 A1 10/2004 Jin et al.
2004/0216263 A1 11/2004 Best et al.
2004/0261212 A1 12/2004 Park et al.
2004/0261213 A1 12/2004 Park et al.
2005/0005390 A1 1/2005 Lee et al.
2005/0005391 A1 1/2005 Park
2005/0081321 A1 4/2005 Milligan et al.
2005/0125939 A1 6/2005 Hansen et al.
2005/0125940 A1 6/2005 McDowell
2005/0183406 A1 8/2005 Coburn
2006/0064828 A1 3/2006 Stein et al.
2006/0090290 A1 5/2006 Lau
2006/0156508 A1 7/2006 Khalil
2007/0163075 A1 7/2007 Butler et al.
2007/0271724 A1 11/2007 Hakan et al.

FOREIGN PATENT DOCUMENTS

CN 1272873.X 1/2003
DE G 79 29 844.5 3/1981
DE 32 28 491 A1 2/1984
DE 33 09 162 A1 9/1984
DE 33 25 336 1/1985
DE 8623004 10/1986
DE 37 43 083 A1 6/1989
DE G 90 10 066.2 10/1991
DE G 91 14 371.3 4/1992
DE 4038262 6/1992
DE 19630286 1/1998
DE 10110581 11/2001
DE 10124216 1/2002
EP 0 170 720 2/1986
EP 0 215 619 A2 3/1987
EP 0 827 710 A2 3/1998
EP 0853917 7/1998
EP 0914795 A2 12/1999
EP 1 070 478 1/2001
EP 1224898 7/2002
EP 1 279 362 1/2003
FR 2603181 6/1987
GB 857580 12/1960
GB 990065 4/1965
GB 1201841 8/1970
GB 2035787 A 6/1980
GB 2137896 10/1984
GB 2155314 9/1985
GB 2189382 A 10/1987
GB 2268875 1/1994

| | | | |
|---|---|---|---|
| GB | 2291790 | | 7/1994 |
| GB | 2 349 105 | | 10/2000 |
| GB | 2 372 434 | | 8/2002 |
| GB | 2398486 | A | 8/2004 |
| GB | 2413942 | | 11/2005 |
| JP | 54-100149 | | 8/1979 |
| JP | 3-267032 | | 11/1991 |
| JP | 4364822 | | 12/1992 |
| JP | 52-73557 | | 10/1998 |
| JP | 2000-070198 | | 3/2000 |
| JP | 2001-095735 | | 4/2001 |
| JP | 2001353110 | | 12/2001 |
| JP | 2002 085297 | A | 3/2002 |
| JP | 2002 136456 | A | 5/2002 |
| JP | 2003 275154 | A | 9/2003 |
| SE | 514314 | C2 | 3/1998 |
| SE | 510283 | C2 | 10/1998 |
| WO | WO 97/20492 | | 6/1997 |
| WO | WO 03/009736 | | 2/2003 |
| WO | WO 2004/069021 | | 8/2004 |
| WO | WO 2005/111084 | | 11/2005 |

OTHER PUBLICATIONS

Black & white printouts of http://www.igia.com/prodetail.cfm?ID=AT7290 "IGIA Vac Blue" (3 pages).

Black & white printouts of http://www.igia.com/prodetail.cfm?ID=AT7739 "Wind Storm Vacuum" (3 pages).

Black & white printouts of http://www.igia.com/prodetail.cfm?ID=AT7691 "Wind Storm Wet/Dry Vacuum" (1 page).

Black & white printouts of http://www.sewserg.com/products/abp09802-0775.html "Wind Storm AT7813 3in1 Upright, Stick & Hand Held Bagless Vacuum Cleaner Windstorm, 4 Attachments, Fold Down Handle for Storage, Weighs under 8 Pounds" (3 pages).

Black & white printouts of http://www.sewserg.com/products/abp02698.html Miele S147 Little Giant Plus Vacuum Cleaner with Free 5 Yr Extended Warranty/Replacement (3 pages).

Color printouts of http://www.zweita.net/ "Product Info" (3 pages).

Color printouts of http://www.igia.com/prodetail.cfm?ID=AT7290 "IGIA Vac Blue" (3 pages).

Color printouts of http://www.igia.com/prodetail.cfm?ID=AT7739 "Wind Storm Vacuum" (3 pages).

Color printouts of http://www.igia.com/prodetail.cfm?ID=AT7691 "Wind Storm Wet/Dry Vacuum" (1 page).

Color printouts of http://www.sewserg.com/products/abp09802-0775.html "Wind Storm AT7813 3in1 Upright, Stick & Hand Held Bagless Vacuum Cleaner Windstorm, 4 Attachments, Fold Down Handle for Storage, Weighs under 8 Pounds" (4 pages).

Color printouts of http://www.sewserg.com/products/abp02698.html Miele S147 Little Giant Plus Vacuum Cleaner with Free 5 Yr Extended Warranty/Replacement.

Fakir product pages catalogue, 2002 (5 pages).

"The BOSS, Heavy Duty Rechargeable Vacuum, Model 98," Eureka brochure dated 1998, 2 pages.

* cited by examiner

HAND HELD VACUUM CLEANER

FIELD OF THE INVENTION

This invention relates to a hand held vacuum cleaner comprising a housing supporting a motor-fan unit, a dust container and an air passage ending in the dust container through which dust laden air is directed into the dust container, the vacuum cleaner also comprising at least one filter arranged after the dust container as seen in the flow direction, the dust container constituting a part of a cyclone separator arranged between the air passage and the filter.

BACKGROUND

Hand held vacuum cleaners which are battery powered as well as powered by mains supply, are previously known, see for instance U.S. Pat. No. 4,967,443, and are used for fast cleaning of small surfaces. It is important that such vacuum cleaners are easily accessible and user friendly designed. These vacuum cleaners are usually designed such that the dust container together with the filter can be removed from the remaining part of the vacuum cleaner housing that contains the fan unit. In order to empty the vacuum cleaner also the filter has to be removed from the dust container before the content can be emptied through the opening which is established when the filter has been taken away. Removal of the dust from the dust container is hence troublesome, dirty and time consuming. It should in this connection be mentioned that the volume of the dust container for this type of vacuum cleaners is very limited and that the filter is rapidly clogged which means lost suction efficiency and that emptying has to be done with short intervals.

It is further known, see EP 914795, to provide a hand held vacuum cleaner of the type mentioned above with a large opening covered by a pivotable lid in order to facilitate emptying but since the dust usually gets stuck to the filter the dust can not be easily poured out of the opening. Moreover since the conventional filter system is quickly clogged the suction efficiency is still not sufficient.

It is also previously known to use the type of hand held vacuum cleaner described above in combination with a shaft part whose lower portion supports a nozzle (so called stick cleaner), see for instance SE 9701543-2. The shaft part is provided with a tube connection by means of which dust laden air is transferred from the nozzle to the air inlet of the hand held vacuum cleaner which is removably secured to the shaft part. This means that the combined stick cleaner in a comfortable way can be used for floor cleaning purpose. Of course this type of vacuum cleaners also has the same disadvantages as the hand held vacuum cleaner described above with respect to filter clogging and handling when being emptied.

SUMMARY OF THE INVENTION

The purpose of this invention is to create an arrangement which eliminates a too fast clogging of the filter and which facilitates emptying of the vacuum cleaner at the vacuum cleaner types described above. This is achieved by means of a device having the characteristics mentioned in the claims.

In a first aspect, the present invention provides a hand held vacuum cleaner having a housing, a motor-fan unit, a dust container, an air passage opening into the dust container and through which dust laden air is directed into the dust container, and at least one filter arranged after the dust container, as seen in the flow direction. The dust container has a first emptying opening, which is normally being covered by a lid and is sized such that it allows the dust collected in the dust container to fall out through the opening when the lid is opened. The dust container also has a second emptying opening that is adapted to be fluidly connected to an external vacuum source via a connection.

In a second aspect, the present invention provides a vacuum cleaner having a housing, a motor-fan unit contained in the housing and having a motor-fan inlet opening, an air inlet passage, and a dust container selectively attachable to the housing. The dust container has a container air inlet adapted to be in fluid communication with the air inlet passage when the dust container is attached to the housing, a container air outlet located at a first end of the dust container and adapted to be in fluid communication with the motor-fan inlet opening when the dust container is attached to the housing, a filter positioned between the container air inlet and the container air outlet, a first emptying opening having a first cover associated therewith, and a second emptying opening having a second cover associated therewith. In this aspect, the dust container can be emptied through the first emptying opening without removing the dust container from the housing.

In a third aspect, the present invention provides a dust container for a vacuum cleaner. The dust container has an air inlet, an air outlet, a first dirt outlet, and a second dirt outlet. The first and second dirt outlets are separate from the air outlet.

BRIEF DESCRIPTION OF THE DRAWINGS

An embodiment of the invention will now be described with reference to the accompanying drawings in which.

DETAILED DESCRIPTION OF PREFERRED EMBODIMENTS

Figure 1:
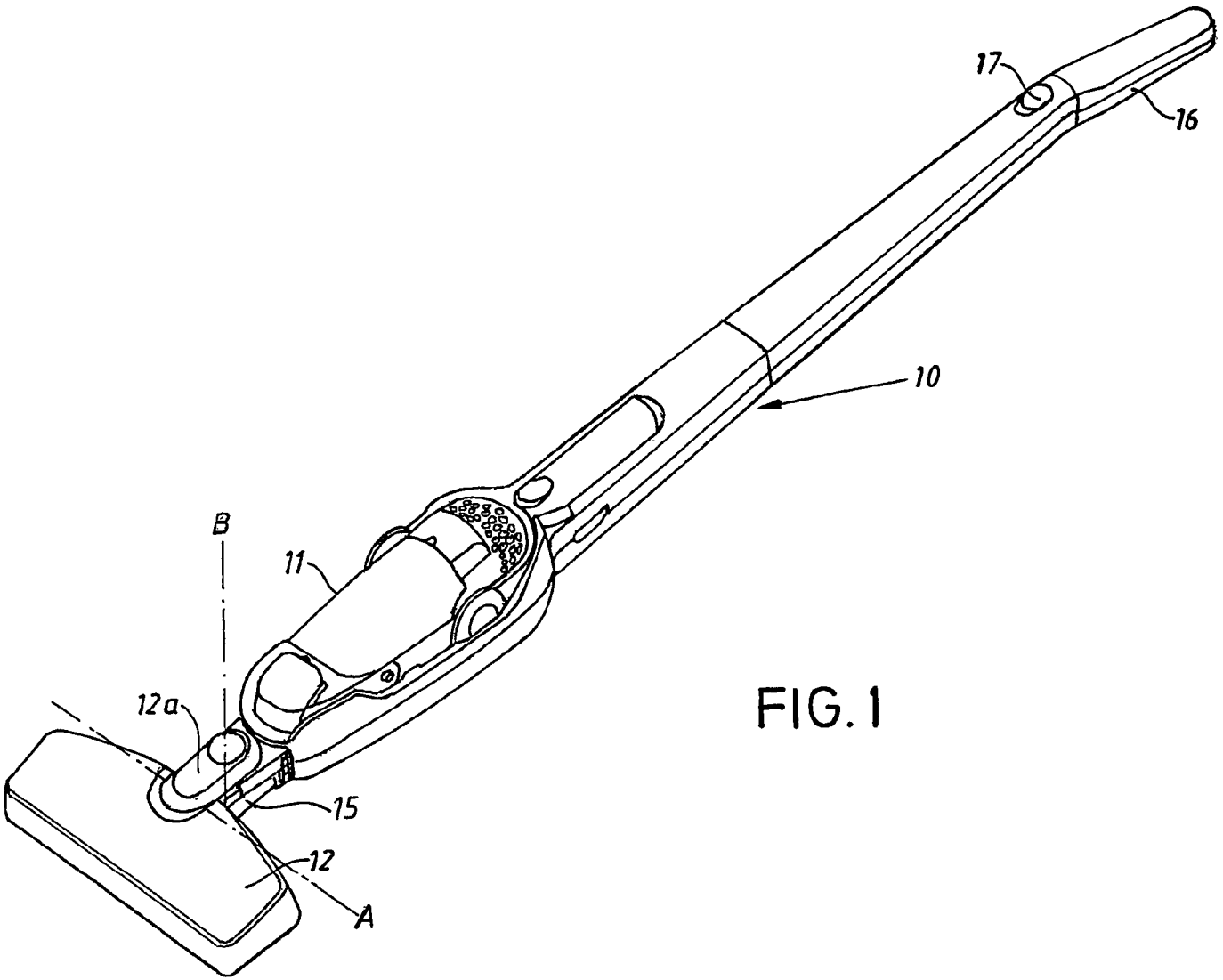
FIG. 1 is a perspective view of the vacuum cleaner in question together with a shaft part.
Figure 2:
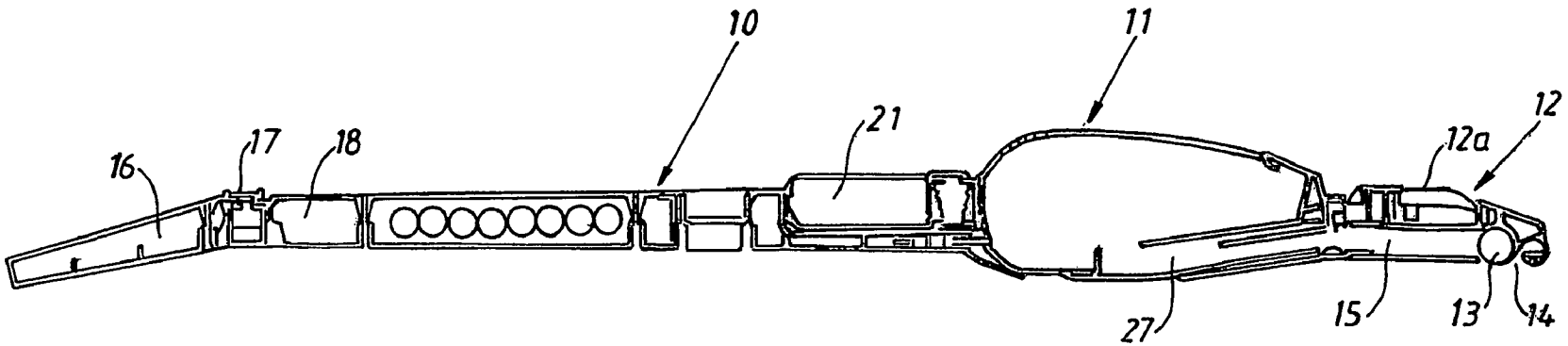
FIG. 2 is a schematic sectional view through the shaft part shown in FIG. 1.
Figure 3:
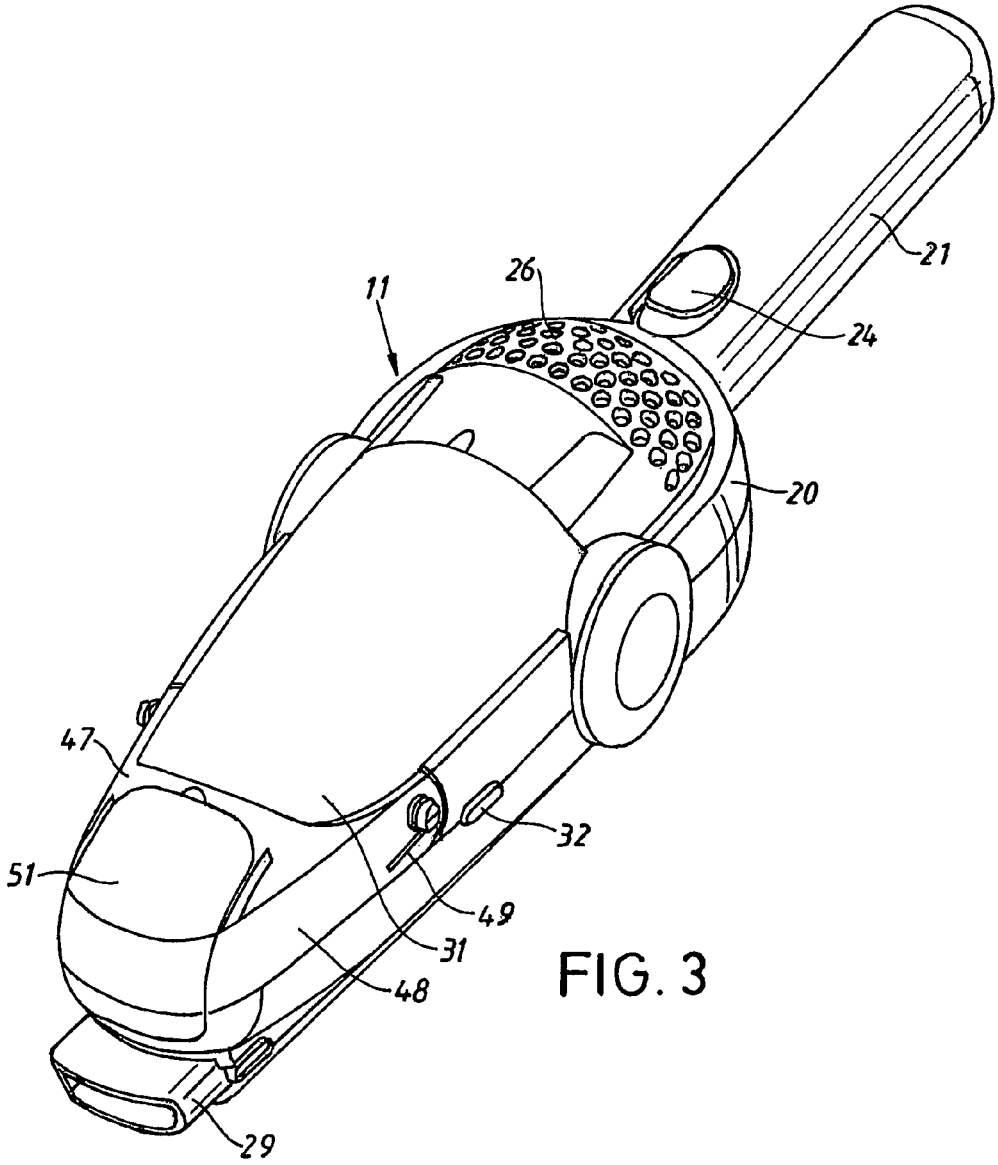
FIG. 3 is a perspective view of the vacuum cleaner being removed.
Figure 4:
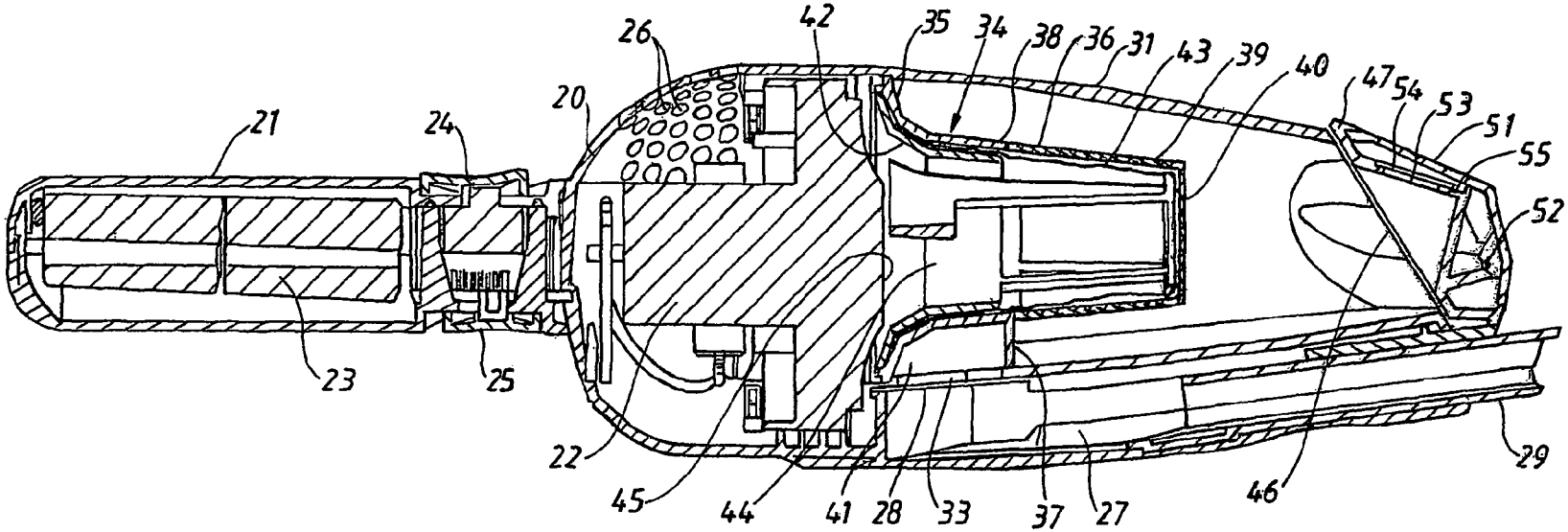
FIG. 4 is a sectional view through the vacuum cleaner.
Figure 5:
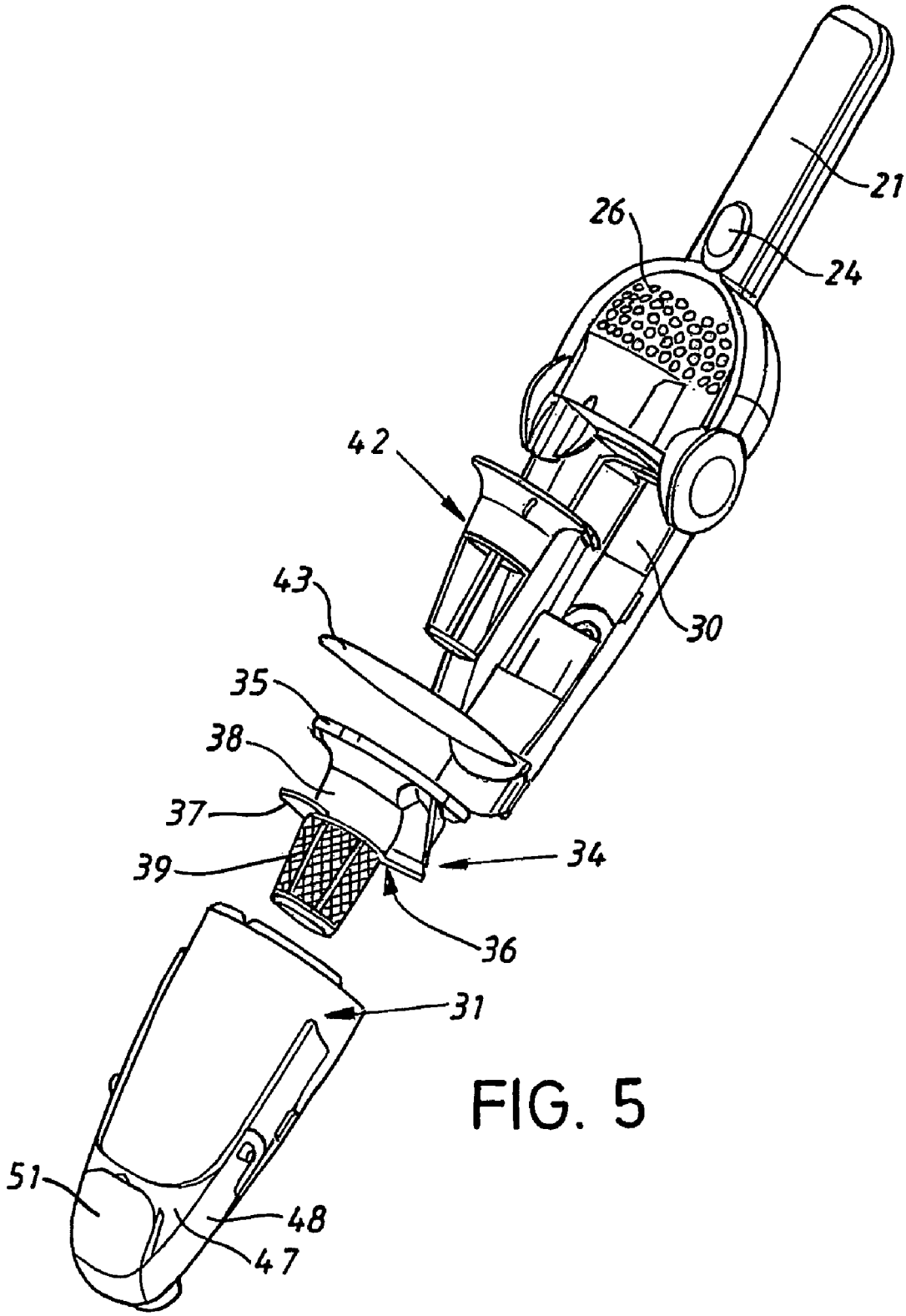
FIG. 5 is an exploded view showing the vacuum cleaner being separated and at the emptying procedure.
Figure 6:
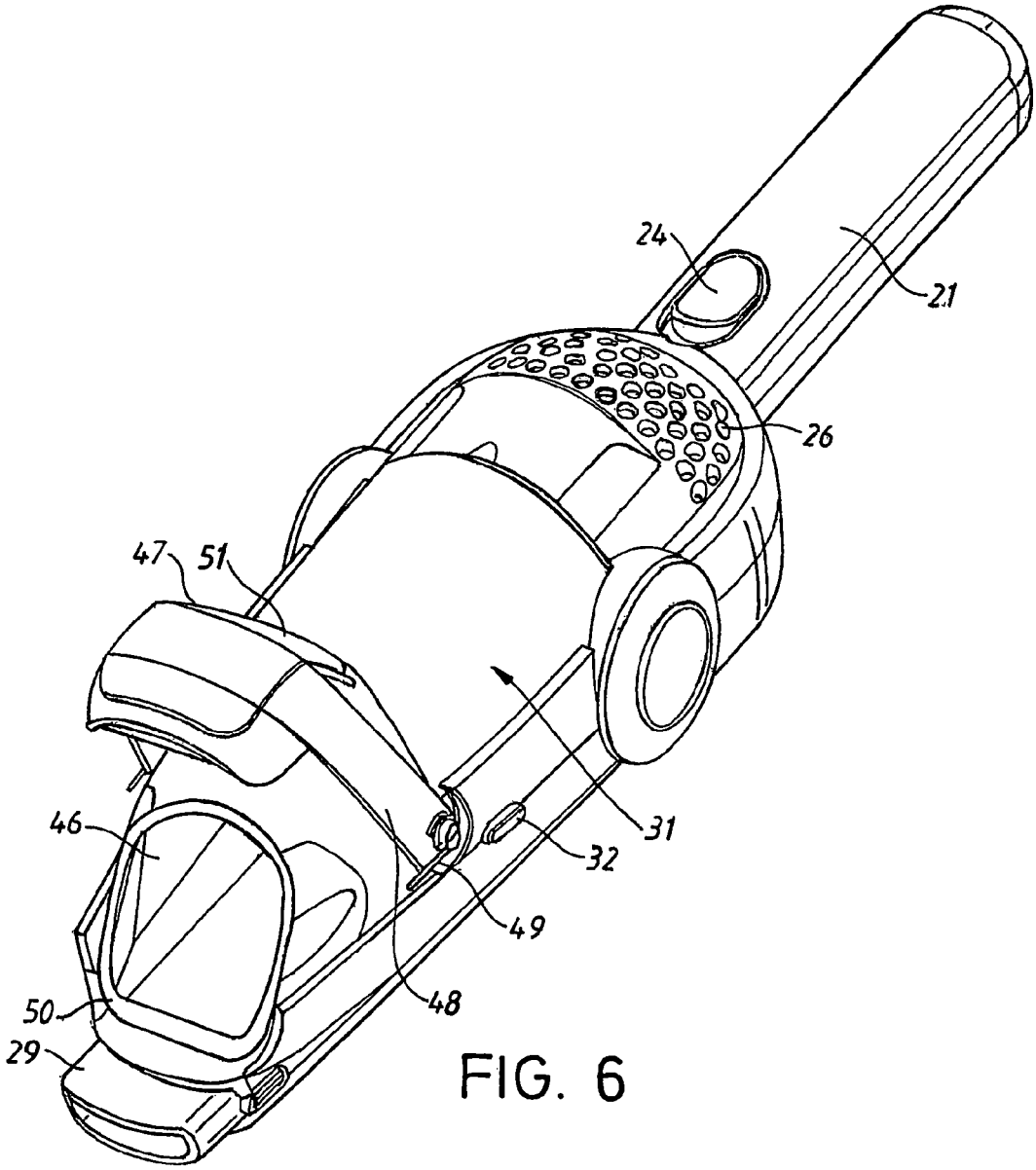
FIG. 6 is a perspective view of the vacuum cleaner showing a different method for emptying the vacuum cleaner whereas FIG. 7 in a perspective view shows a further method for emptying the vacuum cleaner.
Figure 7:
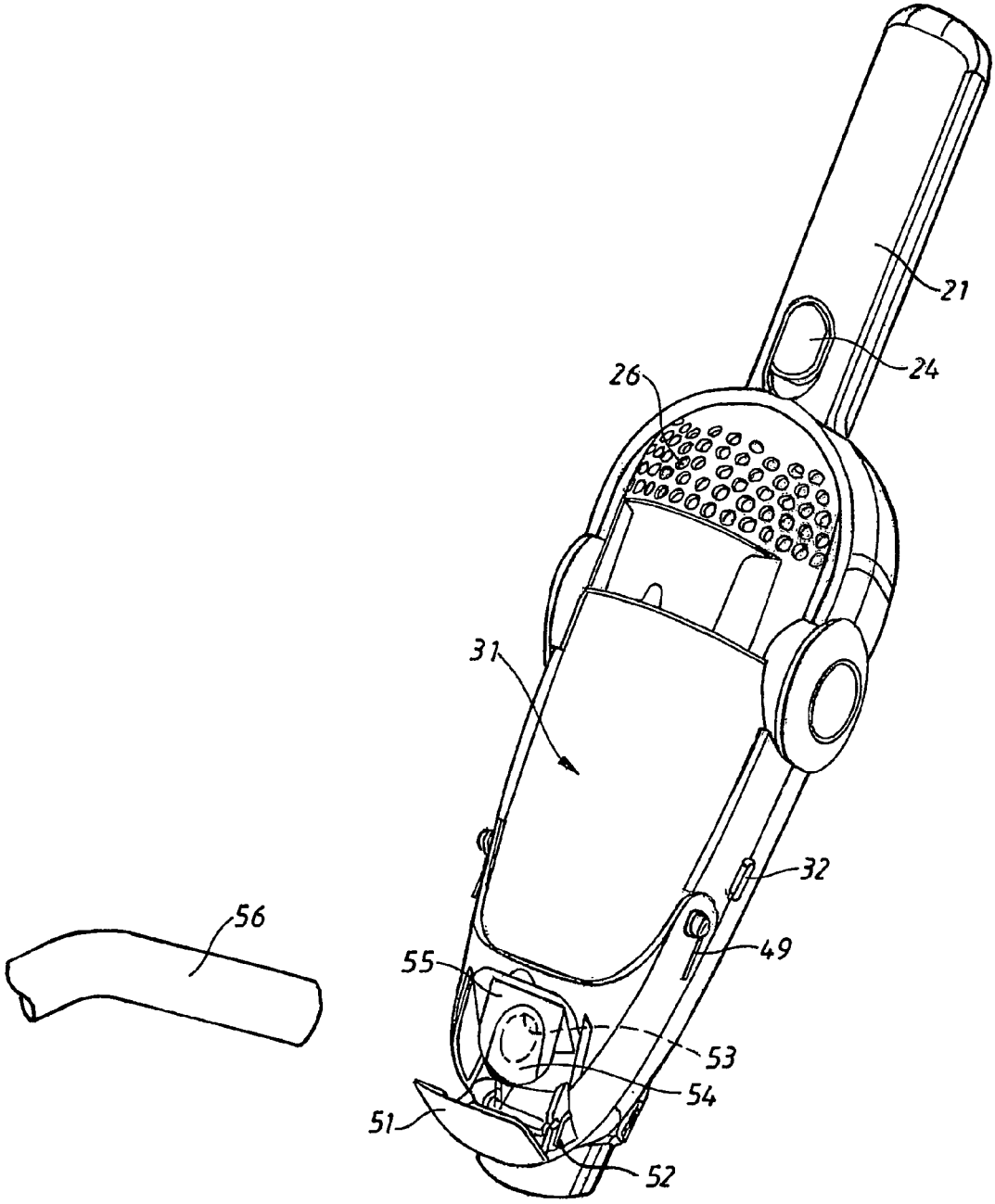

As appears from FIG. 1 the shown vacuum cleaner comprises an elongated shaft part 10 in which a hand held vacuum cleaner 11 is removably arranged. The lower end of the shaft part supports a floor nozzle 12 enclosing an electrically driven brush roll 13, not described in detail, and which is turnably secured to the shaft part 10. The nozzle has an elongated suction opening 14 extending in the length direction of the nozzle and the suction opening is via a flexible tube passage 15 connected to the hand held vacuum cleaner 11 in a manner which will be described below. The upper portion of the shaft part 10 is shaped as a handle 16 and has an operating knob 17 that via an electric circuit, not shown in detail, is connected to the hand held vacuum cleaner when it is secured to the shaft part. The shaft part might also enclose one or several batteries 18 which are connected to the electric circuit.

The nozzle 12 is provided with a supporting part 12*a* having one end that via a shaft is pivotally arranged about a first axis A extending mainly horizontally and mainly parallel to the suction opening 14. The other end of the supporting part 12*a* is pivotally secured to the lower portion of the shaft part 10 about a second axis B that is mainly perpendicular to the length direction of the shaft part 10 and to the first axis A. This means that there is a double link arrangement between the shaft part 10 and the nozzle 11, which gives an excellent maneuverability of the vacuum cleaner when being used as a stick cleaner. This arrangement also makes it possible to easily hide the electric wires between the shaft part 10 and the nozzle within the support arm 12*a*. In order to create a reliable nozzle link the shaft ends defining the axis A are supported by two shaft supports comprising separate units that are removably inserted into pockets in the nozzle.

The hand held vacuum cleaner 11 comprises a housing 20 with a handle 21 and the housing encloses a motor-fan unit 22 driven by one or several batteries 23 placed in the handle 21. The motor-fan unit is controlled by means of a control knob 24 placed at the handle and the part of the electric circuit which is placed in the hand held vacuum cleaner is via a connection 25 connected to the part of the circuit which is placed in the shaft part 10 when the hand held vacuum cleaner is fixed to the shaft part 10. The housing is provided with several openings 26 through which the air flowing through the fan unit leaves the housing. The housing also has an inlet channel 27 extending from the front part of the housing to an outlet opening 28 arranged at the middle part of the housing. In the channel 27 a tube part 29 is slidably arranged the outer end of the tube part being shaped as a nozzle. When the hand held vacuum cleaner is fastened to the shaft part the tube part 29 is pushed into the channel 27 and is thereby a direct continuation of the tube passage 15 of the shaft part. The tube part can also be pulled out to an extended position and by means of a retaining mechanism, not shown, be locked temporarily in the extended position.

The housing is provided with a recess 30 in which a dust container 31 is removably arranged the dust container being removed by means of locking knobs 32 arranged at each side of the container. The dust container 31 is shaped as an elongated body with an open end and is partly made of transparent material. Close to the open end of the dust containerthere is an inlet 33 that is coaxial to the outlet opening 28 of the channel 27. The open end is partly covered by a filter liner 34 that follows the dust container when it is removed from the housing but which is removably arranged with respect to the dust container. The filter liner comprises a collar shaped portion 35 resting against a seat arranged at the wall of the dust container the collar shaped portion continuing into a sleeve shaped portion 36 centrally arranged in the dust container. The sleeve shaped portion has a flange 37 overbridging the distance between the sleeve shaped portion 36 and the surrounding container wall and extends around a part of the circumference of the sleeve shaped portion. The part 38 of the sleeve shaped portion which is placed at one side of the flange 37 is together with the collar shaped portion 35 made by homogenous material whereas the part which is placed at the other side of the flange comprises a grating structure which is covered by a coarse filter 39 that also extends over the end 40 of the sleeve shaped portion. The coarse filter 39 preferably comprises a washable fine meshed plastic net. Further the filter liner 34 is provided with a radially extending wall 41 that stretches between the flange 37 and the collar shaped portion 35 close to the inlet 33. The wall 41 prevents the dust in the dust container from falling out through the inlet 33 if the vacuum cleaner should be turned up-side-down and also limits an annular flow channel around a part of the circumference of the filter liner 34. When dust laden air flows through this channel it contributes to the creation of a vortex in the dust container which will thus operate as a cyclone separator in which larger particles are separated from the air flow at the same time as the process is visualized through the transparent container wall. Thus, the cyclone prevents the filter from being clogged by means of larger dust particles and dirt. By means of the transparent container wall it is also possible to see the dust level in the container and hence also to establish when it is time to empty the container.

The filter liner 34 encloses a removable support body 42 for a fine filter 43 for instance a flat circular paper filter that can be clamped between the support body 42 and the filter liner 34. The support body 42 mainly has the same sleeve shape as the filter liner 34 but is somewhat smaller and forms a flow passage 44 for the air which flows through the coarse filter 39 and the fine filter 43 to the inlet opening 45 of the fan unit. Alternatively the fine filter can be replaced by a body of foamed plastic or the like to separate finer particles after the coarse filter whereby the body is secured in a suitable way in the filter liner.

The dust container has a large emptying opening 46 extending over the entire bottom part of the dust container and the opening is normally covered by a lid 47 supported by a yoke 48 turnably secured at each side of the dust container the yoke being acted on by two springs 49 normally pressing the lid against a seal 50 surrounding the opening 46.

The lid 47 supports a flap 51, that is turnably fastened to the lid 47 by means of dowels 52, and is normally hiding a small, circular emptying opening 53 which is connected to the inside of the dust container. This opening might be covered by a tongue 54 of elastic material which is fastened at one of its sides and rests against a seat 55 surrounding the opening 53 the tongue serving as a check valve that opens when a tube 56 connected to an outer vacuum source is pressed against the seat 55 or is inserted into the opening 53. Instead of using an elastic tongue it is of course possible to provide the seat 55 or the flap 51 with a sealing that prevents air from flowing through the emptying opening 53 into the dust container when the flap is closed.

The hand held vacuum cleaner is used and operates in the following manner. In normal use the hand held vacuum cleaner 11 is removed from the shaft part 10 after which the tube part 29 is pulled out to the outer position. Then the motor fan unit is started by acting on the operating knob 24. This means that air together with dirt particles are sucked in through the tube part 29 and the inlet channel 27. The dust laden air flows through the outlet opening 28 and the inlet 33 of the dust container 31 after which the dust laden air flows into the channel which is limited by the filter liner 34, the flange 37 and the wall of the dust container and extending around the sleeve shaped portion 36. Thereby a vortex is created in the dust container the vortex separating heavier particles from the air flow such that they can be collected at the bottom of the container. The air then flows further through the coarse filter 39 and the fine filter 43 to the flow passage 44 from which the cleaned air leaves to the inlet opening 45 of the fan unit. After having passed the fan unit the air then leaves to atmosphere via the openings 26.

In order to empty the hand held vacuum cleaner there are three different alternatives. By manually opening the lid 46 against the action of the springs 49 the operator can uncover the emptying opening 46 and the collected dust is allowed to fall freely out of the opening or to be shaken out through it. This means a quick emptying function without the need for removing the dust container from the hand held vacuum cleaner. A second quick emptying alternative is, when the operator uses a larger type of vacuum cleaner during a conventional vacuum cleaning operation, to open the flap 51 and press the inlet opening of the tube handle 56 of the larger vacuum cleaner against the seat 55. This means that the tongue 54 because of the vacuum created by the larger vacuum cleaner will uncover the opening 53 and the content in the dust container 31 will be sucked over to the dust container of the larger vacuum cleaner. Thereby also the coarse filter 39 and the fine filter 43 will be cleaned by the air that flows backwards through the hand held vacuum cleaner. A further emptying alternative is to remove the dust container 31 from the housing 20 by acting on the locking knobs 32. Thereby the dust container is removed together with the filter liner 34, the fine filter 43 and the support body 42. By removing the last mentioned three parts from the dust container it can be emptied and the dust container 31, the filter liner 34 with the coarse filter 39 and the support body 42 can be cleaned separately and a new fine filter 43 can then be applied on the support body 43 before it is again inserted into the filter liner 34. filter liner will then be folded such that it achieves a large filter area. The filter liner 34 can then again be inserted into the dust container 31 before the dust container is locked in the housing 20.

The hand held vacuum cleaner 11 can, if the operator so desires, be fixed to the shaft part 10 whereby the tube part 29 is moved to its retracted position at the same time as the electrical circuit of the hand held vacuum cleaner via the connection 25 is connected to the electrical circuit in the shaft part. This means that the motor fan unit of the hand held vacuum cleaner and the electric motor of the brush roll 13 now can be activated by means of the operating knob 17 whereby additional energy is supplied by means of the batteries 18 in the shaft part. The shaft part can then be used as a normal so called stick cleaner for cleaning larger surfaces such as a floor whereby dust laden air is sucked in through the nozzle 12. This air via the flexible tube passage 15 passes to the inlet channel 27 of the hand held vacuum cleaner after which the dust particles are separated in the dust container 31 in a manner described above.

It should be stressed that the hand held vacuum cleaner and/or the shaft part in a conventional manner is provided with a connection, not shown, for an electrical charger to charge the batteries which are placed in the shaft part and/or the hand held vacuum cleaner. The vacuum cleaner might of course also be mains supplied.

The invention claimed is:

1. A hand held vacuum cleaner comprising a housing (20), a motor-fan unit (22), a dust container (31) having an open top that is sealed by connection of the dust container to the housing (20), and an air passage (27) opening into the dust container through which dust laden air is directed into the dust container, the vacuum cleaner further comprising at least one filter (39) arranged after the dust container as seen in the flow direction, the dust container (31) being provided with a first emptying opening (46) normally being covered by a lid (47) and having such a size that the first emptying opening allows the dust collected in the dust container to fall out through the opening when the lid is opened, characterized in that the dust container (31) is provided with a second emptying opening (53) that is adapted to be fluidly connected to an external vacuum source via a connection (56), wherein the first emptying opening and the second emptying opening are separate from the open top of the dust container, characterized in that the dust container constitutes a part of or communicates with a cyclone separator arranged between the air passage (27) and the filter (39).

2. The vacuum cleaner according to claim 1 characterized in that the dust container (31) is removably arranged in the housing.

3. The vacuum cleaner according to claim 1 characterized in that the dust container (31) is provided with a removable filter liner (34) comprising an end wall part (35) continuing into a sleeve shaped portion (36) extending into the dust container and through which the air leaving the dust container flows towards the motor fan unit (22).

4. The vacuum cleaner according to claim 3, wherein the at least one filter (39) comprises a coarse filter, and wherein the filter liner (34) supports the coarse filter.

5. The vacuum cleaner according to claim 3 characterized in that the filter liner (34) encloses a foamed plastic body serving as a separator of finer particles.

6. The vacuum cleaner according to claim 3 characterized in that the filter liner (34) encloses a coaxially arranged, removable support body (42) for a fine filter (43) arranged between the filter liner (34) and the support body (42).

7. The vacuum cleaner according to claim 6 characterized in that the fine filter (43) comprises a thin, flat filter blank which is applied on the support body (42) such that it, when the support body (42) is inserted into the filter liner (34), becomes a folded shape.

8. The vacuum cleaner according to claim 3 characterized in that the filter liner (34) at its outside supports a flange (37) to bridge the distance between the filter liner (34) and the surrounding dust container wall, the flange extending around a part of the circumference of the filter liner.

9. The vacuum cleaner according to claim 1 characterized in that the dust container (31), at least partly, is made of transparent material.

10. The vacuum cleaner according to claim 1, further comprising a shaft part (10) to which the housing can be removably secured, the shaft part supporting a floor nozzle (12) having an elongated suction opening (14) extending in the length direction of the floor nozzle, and wherein the floor nozzle is connected via a tube connection (15) to the air passage (27) when the housing is secured to the shaft part.

11. The vacuum cleaner according to claim 10 characterized in that the floor nozzle (12) and the shaft part (10) are connected to one another via a double link arrangement comprising a first pivot axis (A) that is arranged mainly horizontally and parallel to the suction opening of the floor nozzle and a second pivot axis (B) that is perpendicular to a longitudinal axis of the shaft part as well as to said first pivot axis (A).

12. The vacuum cleaner according to claim 10 characterized in that the tube connection (15) at least partly comprises a flexible hose.

13. The vacuum cleaner according to claim 10, characterized in that the floor nozzle (12) comprises an electrically driven brush roll (13) that is connected to one or more batteries via an electric circuit.

14. A vacuum cleaner comprising:

a housing;

a motor-fan unit contained in the housing and having a motor-fan inlet opening;

an air inlet passage;

a dust container selectively attachable to the housing, the dust container comprising:

a container air inlet adapted to be in fluid communication with the air inlet passage when the dust container is attached to the housing, an open top that is sealed by connection of the dust container to the housing, the open top comprising a container air outlet located at a first end of the dust container and adapted to be in fluid communication with the motor-fan inlet opening when the dust container is attached to the housing, a filter positioned between the container air inlet and the container air outlet, a first emptying opening having a first cover associated therewith, and a second emptying opening having a second cover associated therewith;

wherein the dust container can be emptied through the first emptying opening without removing the dust container from the housing;

wherein the dust container comprises a cyclone separator; and wherein the first emptying opening and the second emptying opening are separate from the open top of the dust container.

15. The vacuum cleaner of claim 14, wherein the container air inlet is adjacent the first end of the dust container.

16. The vacuum cleaner of claim 14, wherein the first emptying opening is distal from the first end of the dust container.

17. The vacuum cleaner of claim 15, wherein the first and second emptying openings are distal from the first end of the dust container.

18. A vacuum cleaner comprising:

a shaft having a first shaft end, a second shaft end, and a mounting location located between the first shaft end and the second shaft end;

a nozzle attached to the first shaft end and having a suction opening facing downwardly therefrom;

an airflow passage forming a fluid communication path between the suction opening and the mounting location;

a handle attached to the second shaft end; and, a handheld unit having a front end and a rear end, the handheld unit being removably attachable to the shaft at the mounting location and comprising:

a housing having a grip adapted to be used to manipulate the handheld unit with one hand;

a motor-fan unit contained within the housing;

one or more batteries located within the housing;

a first control knob adapted to selectively electrically connect the one or more batteries to the motor-fan unit to activate the motor-fan unit;

a motor-fan inlet passing through the housing to allow air to enter the motor-fan unit;

one or more motor-fan outlets passing through the housing to allow air to exit the motor-fan unit;

a dust container extending between the motor-fan inlet and the front end of the handheld unit and covering the motor-fan inlet, the dust container being selectively attachable to the motor-fan unit and having an open top that is sealed by connection of the dust container to the motor-fan unit, the dust container further comprising a first emptying opening located distal from the motor-fan inlet and having a first cover associated therewith, the first cover being openable to empty the dust container, and a second emptying opening located distal from the motor-fan inlet and having a second cover associated therewith, the second cover being openable to empty the dust container, wherein the first emptying opening and the second emptying opening are separate from the open top of the dust container; and an inlet channel extending outside and adjacent the dust container from the front end of the handheld unit to a location proximal to the motor-fan inlet and forming a fluid communication path to a dust container inlet located in a side of the dust container, the inlet channel being located in fluid communication with the airflow passage when the handheld unit is mounted to the shaft.

19. The vacuum cleaner of claim 18, further comprising a second control knob located adjacent the handle and adapted to electrically connect with the handheld unit when the handheld unit is mounted to the shaft and selectively electrically connect the one or more batteries to the motor-fan unit to activate the motor-fan unit.

20. The vacuum cleaner of claim 18, wherein the nozzle comprises a brushroll.

21. The vacuum cleaner of claim 18, wherein the nozzle is pivotally attached to the shaft.

22. The vacuum cleaner of claim 21, wherein the nozzle is attached to the shaft by a supporting part having one end attached to the nozzle such that it can pivot relative to the nozzle about a first axis extending generally parallel with the suction opening, and a second end attached to the first shaft end about a second axis extending perpendicular to the longitudinal axis of the shaft and the first axis.

23. The vacuum cleaner of claim 22, wherein the airflow passage comprises a flexible tube.

24. The vacuum cleaner of claim 22, wherein the airflow passage comprises a flexible tube located adjacent the supporting part.

25. The vacuum cleaner of claim 18, wherein the mounting location comprises a recess into which the handheld unit is received in a nested manner.

26. The vacuum cleaner of claim 18, wherein the dust container is removably mounted within a recess in the housing.

27. The vacuum cleaner of claim 26, wherein at least a portion of the inlet channel is formed through a portion of the housing located adjacent the recess.

28. The vacuum cleaner of claim 18, wherein the dust container comprises a cyclone separator.

29. The vacuum cleaner of claim 28, wherein the handheld unit further comprises a filter located within the dust container between the dust container inlet and the motor-fan inlet.

30. The vacuum cleaner of claim 29, wherein:

the dust container is selectively removable from the handheld unit, and comprises a sidewall that terminates at an open end that generally surrounds the motor-fan inlet when the dust container is attached to the handheld unit; and the filter is selectively positionable within the open end.

31. The vacuum cleaner of claim 30, wherein the filter is spaced radially inward from the sidewall of the dust container and comprises a radially-extending flange bridging the distance between the filter and the sidewall, the flange being located adjacent the dust container inlet such that air entering the dust container inlet passes between a portion of the housing adjacent the motor-fan inlet and the flange, and in a generally tangential direction with respect to the sidewall.

32. The vacuum cleaner of claim 30, wherein the filter is spaced radially inward from the sidewall of the dust container and comprises a radially-extending collar bridging and fluidly sealing the space between the filter and the sidewall.

33. The vacuum cleaner of claim 31, wherein the filter is spaced radially inward from the sidewall of the dust container and comprises a radially-extending collar bridging and fluidly sealing the space between the filter and the sidewall.

34. The vacuum cleaner of claim 29, wherein the filter comprises a washable mesh.

35. The vacuum cleaner of claim 29, wherein the filter comprises a coarse filter and a fine filter, the fine filter being located between the coarse filter and the motor-fan inlet.

36. The vacuum cleaner of claim 35, wherein the coarse filter comprises washable mesh, and the fine filter comprises a paper filter or foamed plastic.

* * * * *

UNITED STATES PATENT AND TRADEMARK OFFICE

CERTIFICATE OF CORRECTION

PATENT NO. : 8,225,456 B2
APPLICATION NO. : 10/544927
DATED : July 24, 2012
INVENTOR(S) : Häkan Miefalk et al.

It is certified that error appears in the above-identified patent and that said Letters Patent is hereby corrected as shown below:

Title Page Item (75) should read

(75) Inventors: Häkan Miefalk, Järfälla (SE); Fredrik Bergling, Nyhamnsläge (SE); Stefan, Jonsson, Stockholm (SE); Esbjörn Svantesson, Täby (SE); Christian Agren, Stockholm (SE)

Signed and Sealed this
Twenty-third Day of October, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,225,456 B2
APPLICATION NO. : 10/544927
DATED : July 24, 2012
INVENTOR(S) : Häkan Miefalk et al.

It is certified that error appears in the above-identified patent and that said Letters Patent is hereby corrected as shown below:

Title Page Item (75) should read

(75) Inventors: Häkan Miefalk, Järfälla (SE); Fredrik Bergling, Nyhamnsläge (SE); Stefan, Jonsson, Stockholm (SE); Esbjörn Svantesson, Täby (SE); Christian Ågren, Stockholm (SE)

This certificate supersedes the Certificate of Correction issued October 23, 2012.

Signed and Sealed this
Twenty-second Day of January, 2013

David J. Kappos

David J. Kappos
*Director of the United States Patent and Trademark Office*